US005760352A

United States Patent [19]

Ishihara et al.

[11] Patent Number: 5,760,352

[45] Date of Patent: Jun. 2, 1998

[54] PUSH SWITCH AND A METHOD OF PRODUCING A PUSH SWITCH

[75] Inventors: Yukihiro Ishihara, Kaizuka; Hiroshi Matsui, Hirakata, both of Japan

[73] Assignee: Matsushita Electric Industrial Co., Ltd., Japan

[21] Appl. No.: 670,591

[22] Filed: Jun. 26, 1996

[30] Foreign Application Priority Data

Jun. 27, 1995 [JP] Japan ..... 7-160414

[51] Int. Cl.[6] ..... H01H 13/14

[52] U.S. Cl. ..... 200/16 D; 200/520

[58] Field of Search ..... 200/5 R, 5 A, 200/16 R, 16 A, 16 B, 16 C, 16 D, 400, 402, 405, 406, 449, 468, 81 R, 83 R, 83 N, 83 P, 83 Z, 81 H, 512, 516, 517, 520, 341, 293, 294

[56] References Cited

U.S. PATENT DOCUMENTS

| | | | |
|---|---|---|---|
| 3,886,012 | 5/1975 | Slater | 156/73.1 |
| 3,981,757 | 9/1976 | Larson | 156/8 |
| 4,125,934 | 11/1978 | Keough et al. | 29/622 |
| 4,318,221 | 3/1982 | Van Benthuysen et al. | 29/622 |
| 4,352,963 | 10/1982 | De Filippis et al. | 200/5 A |
| 4,412,113 | 10/1983 | Mitsugi et al. | 200/67 DB |
| 4,463,233 | 7/1984 | Tanabe | 200/159 A |
| 4,794,215 | 12/1988 | Sawada et al. | 200/159 B |
| 4,822,959 | 4/1989 | Schwab | 200/5 A |
| 4,972,057 | 11/1990 | Miyata | 200/293 |
| 4,987,278 | 1/1991 | Tsutumi | 200/294 |
| 5,152,392 | 10/1992 | Iwasa | 200/517 |
| 5,245,147 | 9/1993 | Kobayashi | 200/520 |
| 5,278,370 | 1/1994 | Miyata et al. | 200/244 |
| 5,313,027 | 5/1994 | Inoue et al. | 200/5 A |
| 5,343,008 | 8/1994 | Ipcinski | 200/302.002 |
| 5,595,288 | 1/1997 | Matsui et al. | 200/513 |

FOREIGN PATENT DOCUMENTS

| | | | |
|---|---|---|---|
| 5298959 | 11/1993 | Japan | H01H 13/52 |

*Primary Examiner*—Michael L. Gellner
*Assistant Examiner*—Michael A. Friedhofer
*Attorney, Agent, or Firm*—Rossi & Associates

[57] ABSTRACT

A push switch is disclosed which includes: an insulation substrate (11) having a circular hollow portion (14) therein, first and second adhesive layers (15A, 15B) on the hollow portion and a top surface respectively and a fixing portion (12A) having a first C-shape and a hollow portion (18), having a second C-shape, arranged inside the first C-shape. The hollow portion is arranged in the circular hollow portion and fixed by the first adhesive layer and the fixing portion fixed on the top surface of the insulation substrate by the second adhesive layer. The hollow portion has at least three protruding portions (19) thereon. A center contact (21) is arranged at inside the second C-shape. There is an arm portion (22) extending from the center contact toward the outside of the second C-shape through an opening of the second C-shape. There is a movable contact (24) having a dome shape on the protruding portions and a cover sheet (26), fixed on the fixing portion so as to cover the movable contact. Sizes of the movable contact and protruding portions are so determined as to provide an ON-OFF operation. A method of producing a push switch is also disclosed wherein the outer contact and the center contact portion having the arm portion are made from a piece of trimmed metal plate by cutting connecting portions connecting them to a frame of the metal plate after arrangement on the switch substrate.

9 Claims, 6 Drawing Sheets

PUSH SWITCH AND A METHOD OF PRODUCING A PUSH SWITCH

BACKGROUND OF THE INVENTION

1. Field of the Invention

This invention relates to a push switch and a method of producing a push switch.

2. Description of the Prior Art

A push switch having first and second contacts, a third movable contact, and an actuator having a dome structure for actuating the third movable contact is disclosed in U.S. Pat. No. 5,313,027.

Another prior art push is disclosed in Japanese patent application provisional publication No. 5-298959. FIG. 6 is a perspective view of this prior art push switch. FIG. 7 is a cross-sectional diagram of this prior art push switch. This prior art push switch comprises a plastic case 1 having a circle hollow portion, an outer fixed contact 4 and a center fixed contact 5, provided on a surface of the hollow portion through an insert molding processing, connected to terminals 2 and 3 respectively, a movable elastic contact 6 having a dome structure placed on the outer contact 4 to always provide a contact between the outer contact 4 and the moveable elastic contact 6, and an insulation cover sheet 7 covering the plastic case 1.

When the insulation cover sheet 7 is depressed, a middle portion of the movable contact 6 is distorted downwardly and contacts with the center fixed contact 5, so that an ON switching condition is provided. When the depression force to the insulation cover sheet 7 is removed, the movable elastic contact 6 restores its dome shape, so that the restoration of the dome shape detaches the movable elastic contact 6 from the center fixed contact 5. Then, an OFF condition is provided. Therefore, this prior switch provides an ON-OFF switching operation.

In this prior art push switch, there is a limit in decreasing a thickness of the plastic case 1 because of the insert molding which is a necessary processing for containing the outer contact 4 and center fixed contact 5 in the plastic case 1.

SUMMARY OF THE INVENTION

The aim of the present invention is to provide an improved push switch and a method of producing a push switch.

According to this invention, a first push switch is provided, which comprises: an insulation substrate having a circular hollow portion therein, a top surface around the hollow portion, first and second adhesive layers on the hollow portion and the top surface respectively; an outer contact portion, comprising a conductive plate, having a fixing portion having a first C-shape and a hollow portion, having a second C-shape, arranged inside the first C-shape, the hollow portion is arranged in the circular hollow portion and fixed by the first adhesive layer and the fixing portion fixed on the top surface of the insulation substrate by the second adhesive layer, the hollow portion having at least three protruding portions thereon; a center contact portion, fixed on a surface of the hollow portion by the first adhesive layer, having a center contact arranged at inside the second C-shape and an arm portion extending from the center contact toward outside of the second C-shape through an opening of the second C-shape; a movable contact, having a dome shape having an outer circumference portion on the protruding portions; and a cover sheet (26), having a third adhesive layer (25), fixed on the fixing portion so as to cover the movable contact.

In the push switch as mentioned, sizes of the movable contact and protruding portions are so determined that an electrical pass between the fixing portions and the arm portion is made when the movable contact is depressed toward the center contact and is removed when the movable contact is not depressed toward the center contact. That is, sizes of the movable contact and protruding portions are so determined as to provide an ON-OFF operation.

In the push switch as mentioned, the insulation substrate comprises a first substrate having a fourth adhesive layer and a second substrate having the first adhesive layer and a circular hole therein, the second substrate is fixed on the first substrate by the fourth adhesive layer, a portion of the fourth adhesive layer exposed through the circular hole acting as the first layer.

According to this invention, a second push switch is provided, which comprises: an insulation substrate having a first hollow portion therein, a top surface around the hollow portion; an outer contact portion, comprising a conductive plate, having an outer portion having a first C-shape and a second hollow portion, having a second C-shape, arranged inside the first C-shape, the second hollow portion is arranged in the first hollow portion, the second hollow portion having at least three protruding portions thereon; a first fixing portion for fixing the outer portion on the top surface of the insulation substrate; a center contact portion having a center contact arranged at inside the second C-shape and an arm portion extending from the center contact toward outside of the second C-shape through an opening of the second C-shape; a second fixing portion for fixing the center contact portion on a surface of the first hollow portion; a movable contact, having a dome shape having an outer circumference portion on the protruding portions; and an insulation cover sheet on the movable contact for insulating the movable contact.

In the second push switch, sizes of the movable contact and protruding portions are so determined that an electrical pass between the outer portion and the arm portion is made when a force is applied to the movable contact toward the center contact and the electrical pass is removed when the force is removed.

According to this invention, a method of producing a push switch is provided, which comprises the steps of: forming a conductive plate having a frame, an outer contact portion and an inside contact portion inside the outer contact portion separated from the outer contact portion, and connection portions for connecting the frame to the outer contact portion and the inside contact portion; arranging the conductive plate on a substrate formed to support the outer contact portion and the inside contact portion; cutting the connection portions; and arranging a movable contact, having a dome shape, on the outer contact portion, wherein the movable contact makes an electrical pass between the outer contact and the inside contact when the movable contact is depressed. That is, the outer contact and the inside contact portion having the arm portion are made from a piece of trimmed metal plate by cutting connecting portions connecting them to a frame of the metal plate after arrangement on the switch substrate.

BRIEF DESCRIPTION OF THE DRAWINGS

The object and features of the present invention will become more readily apparent from the following detailed description taken in conjunction with the accompanying drawings in which.

The same or corresponding elements or parts are designated with like references throughout the drawings.

DETAILED DESCRIPTION OF THE INVENTION

Hereinbelow will be described an embodiment of this invention.

Figure 1:
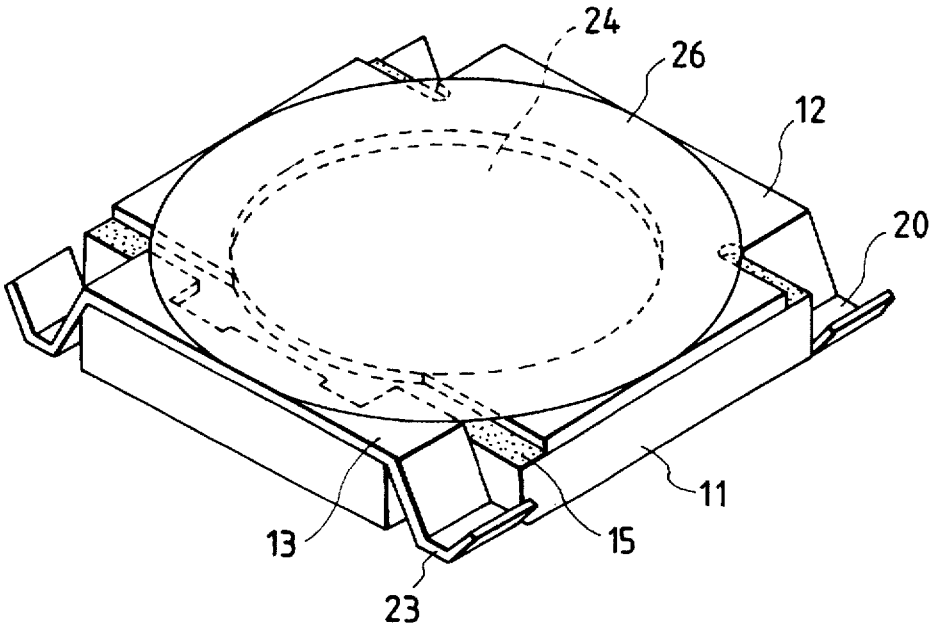
FIG. 1 is a perspective view of a push switch of this embodiment.
Figure 2:
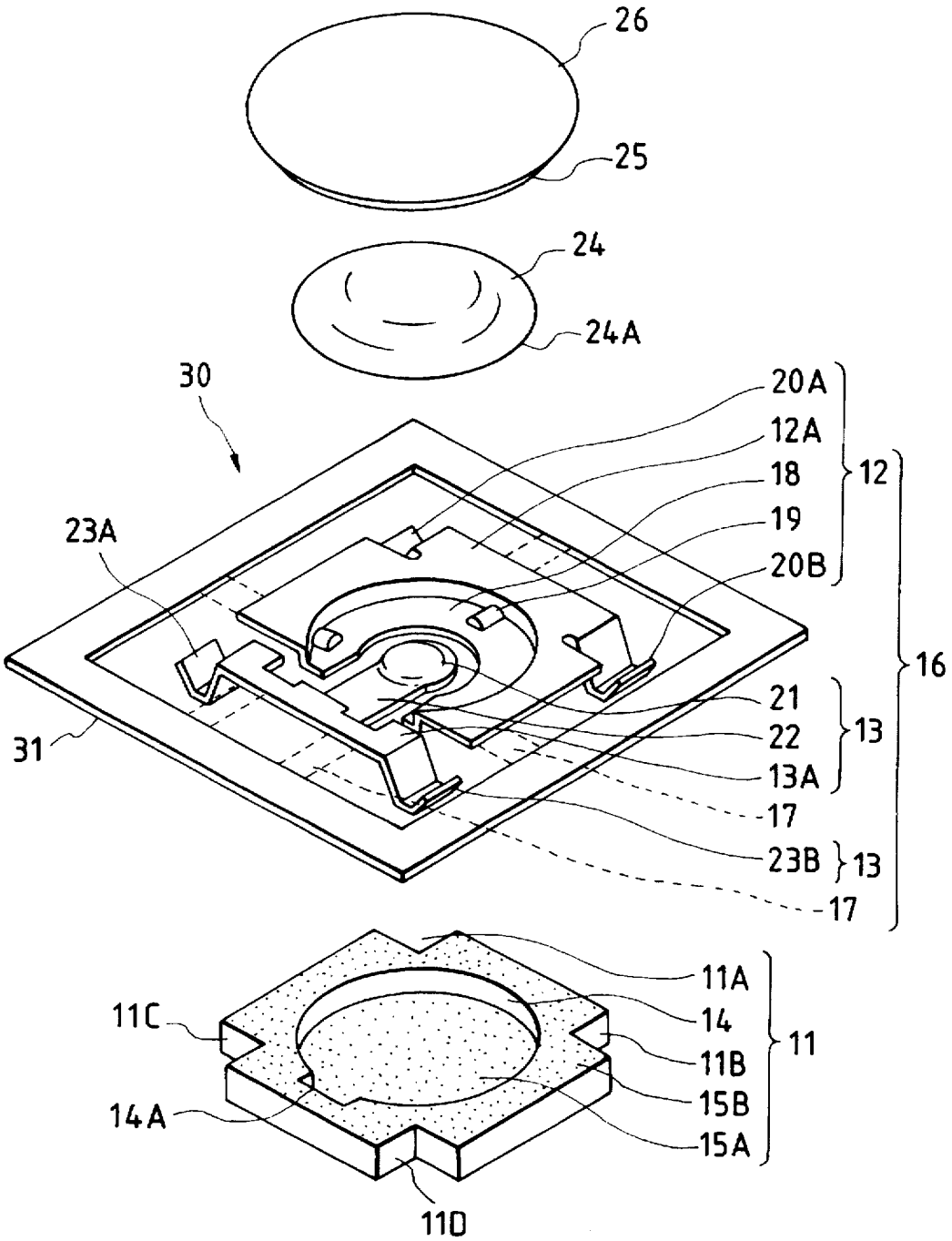
FIG. 2 is a perspective view of the push switch of this embodiment showing an assembling condition.
Figure 3:
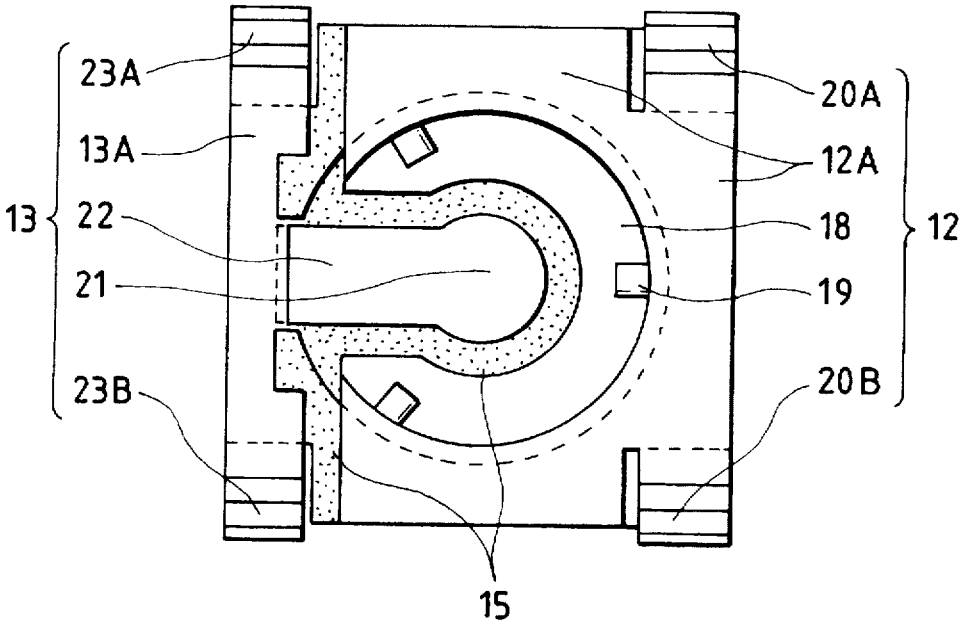
FIG. 3 is a plan view of the push switch of this embodiment in a partially assembled condition.
Figure 4:
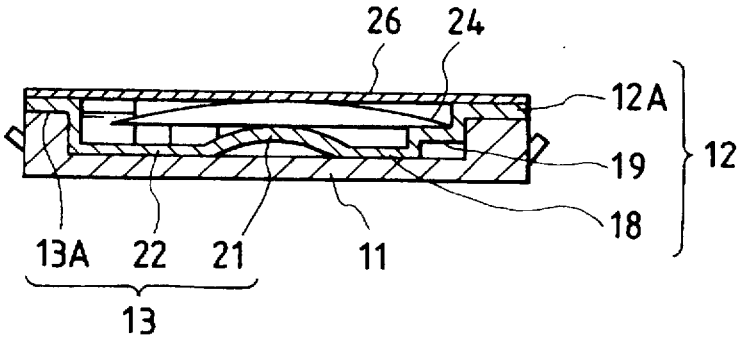
FIG. 4 is a cross-sectional view of the push switch of this embodiment.

FIG. 1 is a perspective view of a push switch of this embodiment. FIG. 2 is a perspective view of the push switch of this embodiment showing an assembling condition. FIG. 3 is a plan view of the push switch of this embodiment in a partially assembled condition. FIG. 4 is a cross-sectional view of the push switch of this embodiment.

The push switch of this embodiment comprises and insulation switch substrate 11 having a circular hollow portion 14 having a circle shape, wherein a notch 14A is provided to circumference of the hollow portion 14, an outer contact portion 12 including an outer contact 12A having a C-shape and a hollow portion 18 having a C-shape also arranged in the circular hollow portion 14, a center contact portion 13 having a center contact 21 arranged at a center of an area surrounded by the C-shaped hollow portion 18 and an arm 22 extending from the center contact 21 to outside of the C-shaped outer contact 12A through an opening of the C-shape of the outer contact 12A, an adhesive layer 15A on the surface of the circular hollow portion 14 for fixing the hollow portion 18 and the center contact portion 13, an movable contact 26 having a dome shape, another adhesive layer 15B on a top surface of the switch substrate 11, and an elastic cover sheet 26 fixed by the adhesive layer 15B for covering the switch substrate 11, the outer contact and the center contact portion 13.

The switch substrate 11 comprises an insulation thin plate, having a square shape, which is processed by heating with a pressure to form the hollow portion 14 with the notch 14A at the middle thereof.

Figure 8A:
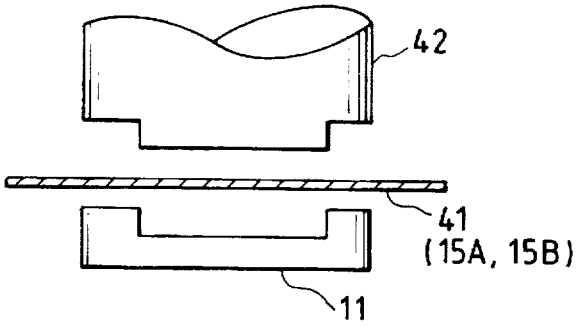
FIGS. 8A and 8B are side views of the switch substrate of this embodiment under processing.
Figure 8B:
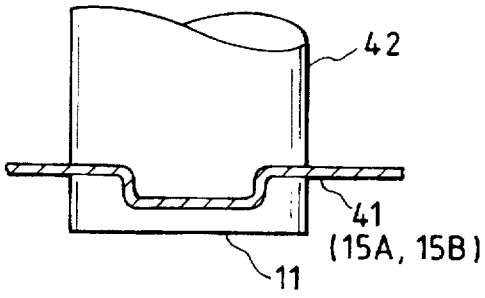

FIGS. 8A and 8B are side views of the switch substrate 11 of this embodiment under processing.

Then, a sheet type of adhesive 41 is fixed on to provide the adhesive layer 15B on the top surface of the switch substrate 11 and the adhesive layer 15A on the surface of the hollow portion 14 by pressing with a punch 42 as shown in FIG. 8B. Then, the switch substrate 11 is processed by a press working (trimming) to form notches 11A to 11D at corners of the square shape.

Figure 9:
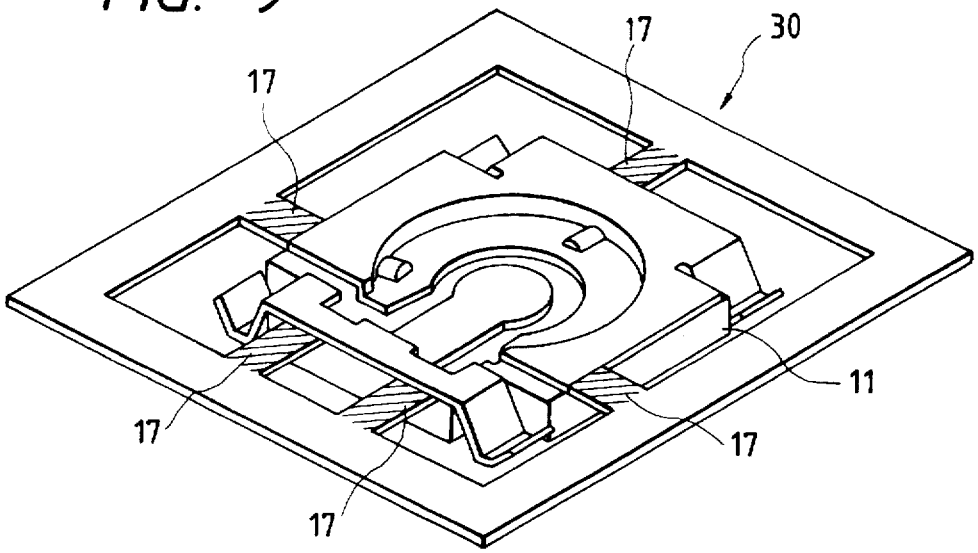
FIG. 9 is a perspective view of a thin metal plate of this embodiment under processing.
Figure 10:
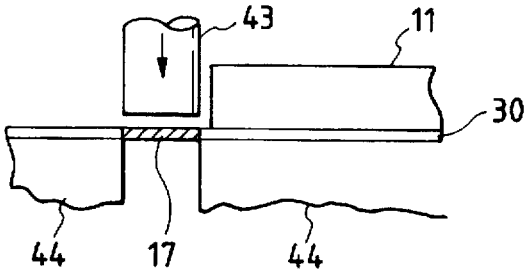
FIG. 10 is a cross-sectional view of the thin metal plate under processing.

FIG. 9 is a perspective view of a thin metal plate of this embodiment under processing. FIG. 10 is a cross-sectional view of the thin metal plate under processing.

The outer contact portion 12 and the center contact portion 13 are formed from the thin metal plate 30. The thin metal plate 30 is processed by a press working (trimming) to provide the outer contact portion 12, the center contact portion 13, connecting portions 17, and a frame 31, is fixed to the switch substrate 11 by the adhesive layers 15A and 15B as shown in FIG. 9. Then, the processed thin plate 30 is cut to remove the connecting portions 17 and the frame 11 by punching with a punch and a metallic mold 44 as shown in FIG. 10, so that the outer contact 12 and the center contact 13 are provided on the switch substrate 11 with a space.

The outer contact portion 12 have a substantially C-shape or an open loop shape, and includes the outer contact 12A and the hollow portion 18 which is formed to have a C-shape by a drawing processing to fit the hollow portion 18 in the circular hollow portion 14 in the switch substrate 11. The outer contact 12A is fixed on the top surface of the switch substrate 11 by the adhesive layer 15B and the hollow portion 18 is fixed on the surface of the hollow portion 14 by the adhesive layer 15A. The hollow portion 18 has at least three protruding portions 19, having a predetermined height, for supporting the movable contact 24 with electrical connection between the movable contact 24 with the hollow portion 18 with a gap between the circumference of the dome contact 24 and the hollow portion 18. From the outer contact 12A, terminal portions 20A and 20B are extended and folded downwardly (in FIG. 2) by a thickness of the switching substrate 11 to fit the terminal portions 20A and 20B in the notches 11A and 11B of the switching substrate 11.

In the center contact portion 13, the center contact 21 having a dome shape to provide a surer contact with the movable contact 24 is arranged at the middle of the C-shape of the C-shaped hollow portion 18 to provide an electrical insulation from the hollow portion 12A. From the center contact 21, the arm portion 22 extends through the opening of the C-shape of the hollow portion 18 into the notch 14A and folded upwardly (in FIG. 2) with the folded portion fitted in the notch 14A. A fixing portion 13A extending from the arm portion 22 extends to the right from the folded portion and branches off to the left. At both ends of the fixing portion 13A, terminal portions 23A and **23*b* are formed by folding downwardly (in FIG. 2) by the thickness of the switch substrate 11 to fit them in the notches 11C and 11D. The fixing portion 13A and the arm portion 22 and the center contact 21 are fixed to the top surface of the switch substrate 11 and the surface of the hollow portion 14**.

FIG. 3 shows a condition that the outer contact portion 12 and the center contact portion 13 are fixed on the switch substrate 11.

The movable contact 24 is elastic and is made of a thin metal plate having the dome shape arranged on the protruding portions 19 above the center contact 21 of the center contact portion 13 wherein a circumference of the dome shape on the three protruding portions 19 on the C-shape hollow portion 18 is separated with a gap from the arm portion 22 by the height of the protruding portions 19. That is, in a normal condition, that is, when the push switch is not depressed, or a force is not applied to the movable contact 24, the outer circumference of the movable contact 24 is separate from the arm portion 22 by the protruding portions 19 by the height of the protruding portions 19 to electrically insulate the outer contact portion 12 from the center contact 13 through the movable contact 24. In this embodiment, the outer circumference of the movable contact 24 is separated form the arm portion 22 when a force applied to the movable contact 24.

The cover sheet 26, which is flexible and non-conductive, covers the top surface of the outer contact 12A and the movable contact 24 and is fixed to the outer contact 12A and the movable contact 24 by an adhesive layer 25 provided on the lower surface (in drawings) thereof.

The arm portion 22 fits into the notch 14A to electrically insulate a portion of the arm portion 22 bent upwardly (in FIGS. 2 and 4) from the outer circumference of the movable contact 24.

An operation of this push switch of this embodiment will be described.

When the cover sheet 26 is depressed, a center portion of the movable contact 24 is deformed downwardly (in drawings) and contacts with the center contact 21 of the center contact portion 13, so that a pass between the outer contact portion 12 and the center contact portion 13 is closed, that is, a pass between the terminals 20A (20B) and 23A (23B) are closed.

When removal of a force depressing the center portion of the cover sheet 24, that is, the movable contact 24 restores the shape of the movable contact 24 to the original dome shape, so that the movable contact 24 separates from the center contact portion 13 and the pass between the terminals 20A (20B) and 23A (23B) is removed.

A modification will be described. This provides an ON-OFF switching operation.

Figure 5A:
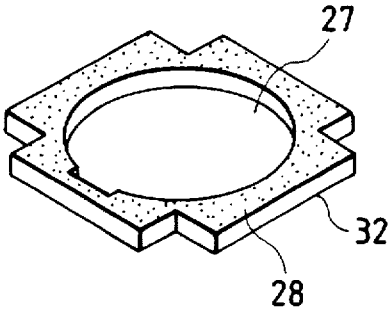
FIGS. 5A to 5C are perspective view of a modification of this embodiment.
Figure 5B:
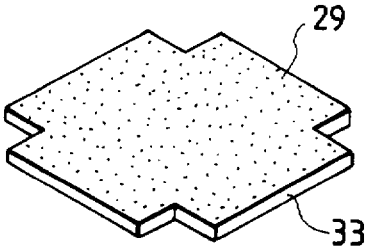
Figure 5C:
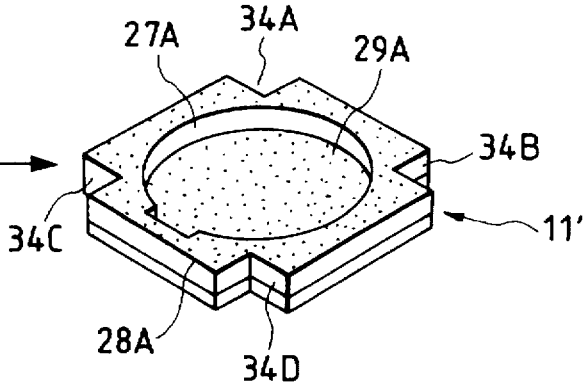
Figure 6:
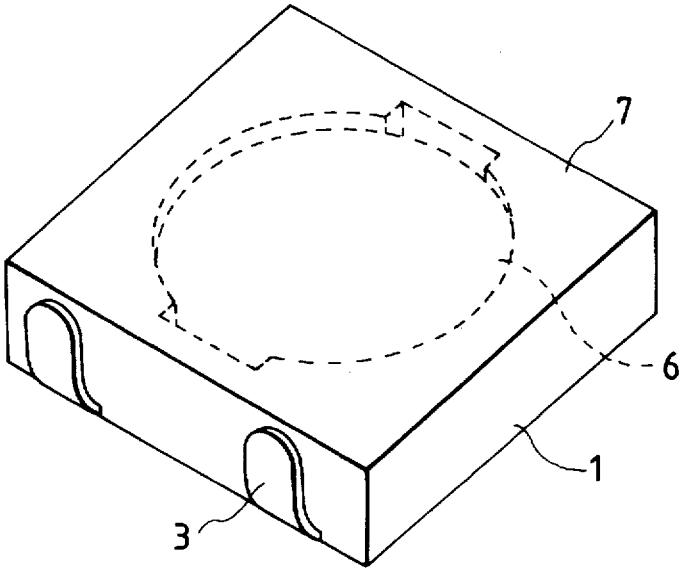
FIG. 6 PRIOR ART
FIG. 6 is a perspective view a prior art push switch.
Figure 7:
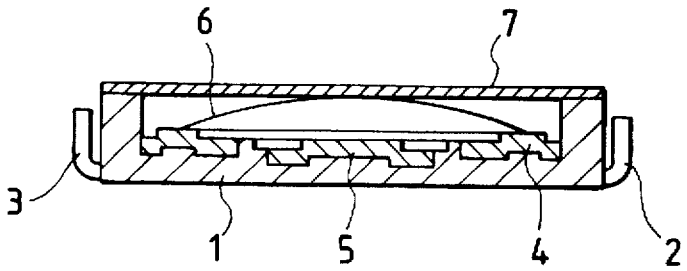
FIG. 7 PRIOR ART
FIG. 7 is a cross-sectional diagram of the prior art push switch.

FIGS. 5A to 5C are perspective view of a modification of this embodiment.

In the above-mentioned embodiment, the switch substrate 11 is formed by heating and pressing one insulation thin plate to provide the hollow portion 14. However, there are various ways to form this switch substrate 11. For example, another switch substrate 11' is provided by combining a substrate 32 where a circular hole 27 is formed in a square substrate at a center thereof and notches are formed at corners thereof and a substrate 33 where notices are formed in a square substrate correspondingly by an adhesive layer 29 on the substrate 33. Another adhesive layer 28 is formed on a top surface of the substrate 32. Therefore, the switch substrate 11' is provided as shown in FIG. 5C. That is, the switch substrate 11' has a circular hollow portion 27A, notches 34A to 34B, an adhesive layer 28A on a top surface of the switch substrate 11', and a surface of the hollow portion 29A.

The push switch according to the embodiment mentioned above requires no molding processing to contain the contacts in the switch substrate.

Moreover, when the movable contact 24 and the cover sheet 26 are assembled, the movable contact 26 is positioned by the difference in level between the C-shape hollow portion 18 and the outer contact 12 and it is prevented that the movable contact 26 slides during assembling.

As mentioned, the push switch comprises: the insulation switch substrate 11 having a first hollow portion 14 therein, a top surface around the hollow portion 14; the outer contact portion 12, comprising the conductive plate, having an outer contact 12A having a first C-shape and the second hollow portion 18, having a second C-shape, arranged inside the first C-shape, the second hollow portion is arranged in the first hollow portion, the second hollow portion having at least three protruding portions 19 thereon; the adhesive layer 15B, terminal portions, notches 11A and 11B as a first fixing portion for fixing the outer contact 12A on the top surface of the insulation substrate 11; a center contact portion 13 having the center contact 21 arranged at inside the second C-shape and the arm portion 22 extending from the center contact 21 toward outside of the second C-shape through an opening of the second C-shape; the adhesive layer 15A, terminal portions 23A and 23B, notches 11C and 11D as a second fixing portion for fixing the center contact portion; the movable contact 24, having a dome shape having an outer circumference portion 24A on the protruding portions; and the insulation cover sheet 26 on the movable contact 24 for insulating the movable contact 24. Sizes of the movable contact 24 and protruding portions 19 are so determined that an electrical pass between the outer portion 12A and the arm portion 22 is made when a force is applied to the movable contact 24 toward the center contact 21 and the electrical pass is removed when the force is removed.

Moreover, according to this embodiment, the method of providing a push switch as follows:

The conductive plate 30 is formed to have the frame 31, the outer contact portion 12 and the center contact portion 13, separated from the outer contact portion, inside the outer contact portion 12, and the connection portions 17 for connecting the frame 31 to the outer contact portion 12 and the center contact portion 13. The conductive plate 30 is arranged on the insulation switch substrate 11 formed to support the outer contact portion 12 and the center contact portion 13. The connection portions 17 are cut. The movable contact 24, having a dome shape, is arranged on the outer contact portion 12, wherein the movable contact 24 makes an electrical pass between the outer contact and the inside contact when the movable contact is depressed.

The center contact portion 13 is separated from the movable contact by the protruding portion 19.

What is claimed is:

1. A push switch comprising:

an insulating substrate having a first circular hollow portion therein, a top surface around said first hollow portion, first and second adhesive layers on said first hollow portion and said top surface respectively;

an outer contact portion, comprising a conductive plate, having a fixing portion having a first C-shape and a second hollow portion being arranged in said first circular hollow portion and fixed by said first adhesive layer and said fixing portion fixed on said top surface of said insulation substrate by said second adhesive layer, said second hollow portion having at least three protruding portions thereon;

a center contact portion, fixed on a surface of said second hollow portion by said first adhesive layer, having a center contact arranged inside said second C-shape and an arm portion extending from the center contract toward the outside of said second C-shape through an opening of said second C-shape;

a movable contact, having a dome shape having an outer circumference portion on said protruding portions; and a cover sheet, having a third adhesive layer, fixed on said fixing portion so as to cover the movable contact.

2. A push switch as claimed in claim 1, wherein sizes of said movable contact and protruding portions are so determined that an electrical pass between said fixing portion and said arm portion is made when said movable contact is depressed toward said center contact and is removed when said movable contact is not depressed toward said center contact.

3. A push switch as claimed in claim 1, wherein said insulation substrate comprises a first substrate having a fourth adhesive layer and a second substrate having said first adhesive layer and a circular hole therein, said second substrate is fixed on said first substrate by said fourth adhesive layer, wherein a portion of said fourth adhesive layer is exposed through said circular hole acting as said first layer.

4. A push switch comprising:

an insulating substrate having a first circular hollow portion therein, a top surface around said first hollow portion;

an outer contact portion, comprising a conductive plate, having an outer portion having a first C-shape and a second hollow portion, having a second C-shape, arranged inside said first C-shape, said second hollow portion is arranged in said first hollow portion, said second hollow portion having at least three protruding portions thereon;

first fixing means for fixing said outer portion on said top surface of said insulation substrate;

a center contact portion having a center contact arranged inside said second C-shape and an arm portion extending from the center contact toward the outside of said second C-shape through an opening of said second C-shape;

second fixing means for fixing said center contact portion on a surface of said first hollow portion;

a movable contact, having a dome shape having an outer circumference portion on said protruding portions; and an insulation cover sheet on said movable contact for insulating said movable contact.

5. A push switch as claimed in claim 4, wherein sizes of said movable contact and protruding portions are so determined that an electrical pass between said outer portion and said arm portion is made when a force is applied to said movable contact toward said center contact and said electrical pass is removed when said force is removed.

6. A method of providing a push switch comprising the steps of forming a conductive plate having a frame having a loop, an outer contact portion and an inside contact portion inside said outer contact portion separated from said outer contact portion, and connection portions for connecting said frame to said outer contact portion and said inside contact portion;

arranging said conductive plate on a substrate formed to support said outer contact portion and said inside contact portion;

cutting said connection portions; and arranging a movable contact, having a dome shape, on said outer contact portion, wherein said movable contact makes an electrical pass between said outer contact portion and said inside contact portion when said movable contact is depressed.

7. A method as claimed in claim 6, wherein the step of cutting is effected such that a shape of said frame is maintained.

8. A method as claimed in claim 6, wherein said connection portions are formed inside said frame.

9. A method as claimed in claim 6, wherein said step of arranging said conductive plate on said substrate comprises the step of adhesively fixing said conductive plate on said substrate.

* * * * *